United States Patent [19]

Carter et al.

[11] 4,408,432

[45] Oct. 11, 1983

[54] TRIM STRIP ASSEMBLY

[75] Inventors: Gordon V. Carter; Ralph D. Tromble, both of Louisville, Ky.

[73] Assignee: General Electric Company, Louisville, Ky.

[21] Appl. No.: 408,385

[22] Filed: Aug. 16, 1982

[51] Int. Cl.[3] ..... E04C 2/38

[52] U.S. Cl. ..... 52/718; 428/31; 428/61; 293/128

[58] Field of Search ..... 428/31, 61; 52/716–718; 293/1, 128; 24/292, 297

[56] References Cited

U.S. PATENT DOCUMENTS

| | | | |
|---|---|---|---|
| 3,506,294 | 4/1970 | Newman | 293/1 |
| 3,606,432 | 9/1971 | Honatzis | 293/1 |
| 3,843,475 | 10/1974 | Kent | 161/4 |
| 4,015,760 | 4/1977 | Bott | 224/42.1 D |
| 4,066,285 | 1/1978 | Hall et al. | 293/62 |
| 4,265,383 | 5/1981 | Ferguson | 224/326 |

*Primary Examiner*—Alexander S. Thomas

*Attorney, Agent, or Firm*—Frederick P. Weidner; Radford M. Reams

[57] ABSTRACT

A trim strip assembly attached to a substrate body including an elongated rigid member fastened to the substrate body and having a terminal end with upturned spaced tabs. A trim strip is secured to the rigid member and has two parallel longitudinal downwardly curved elongated areas and a terminal end. An end cap is attached to the rigid member and trim strip and has a forward terminal end, a top wall, and a rear wall the bottom edge of which abuts the end of the rigid member. The end cap has two spaced flat resilient legs projecting from the rear wall and their forward ends extending beyond the forward terminal end and each leg is in contact with a respective longitudinal downwardly curved elongated area of the trim strip. The legs are spaced from the top wall of the end cap to allow insertion under the terminal end of the trim strip and each leg lies in a plane that bisects the other and at the same acute angle relative to the horizontal plane. Each leg has a cutout portion at the rear to receive the respective upturned tabs of the rigid member when the end cap is secured to the rigid member and trim strip.

6 Claims, 10 Drawing Figures

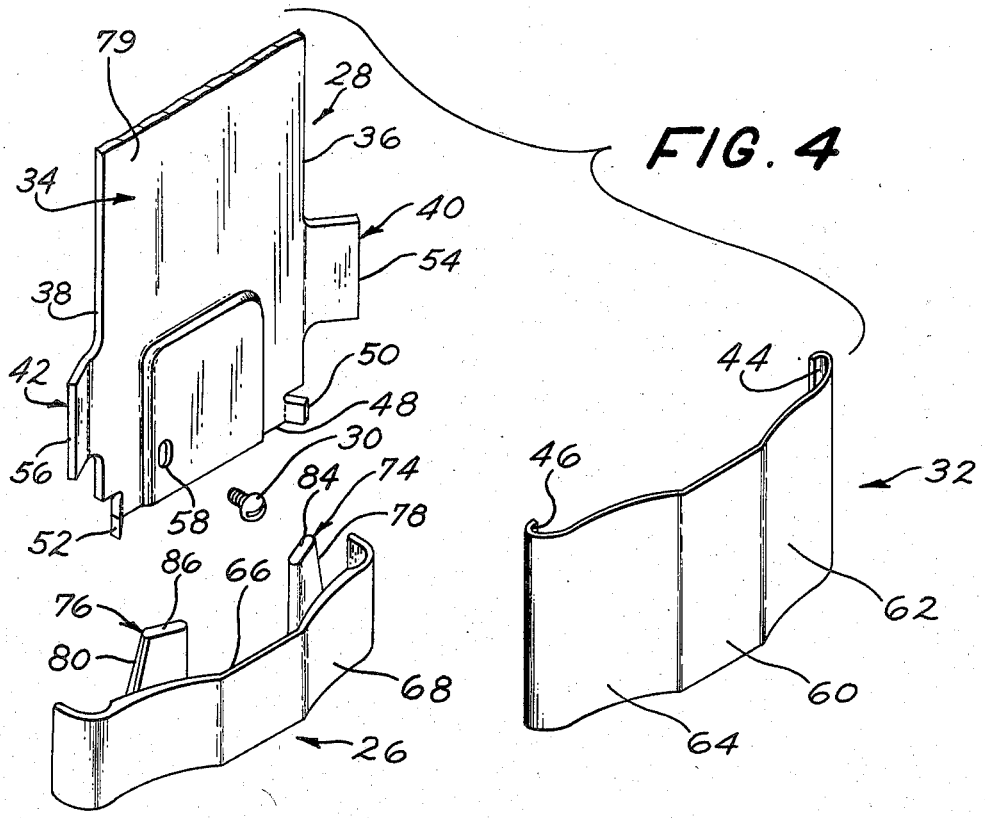
FIG. 4
FIG. 8
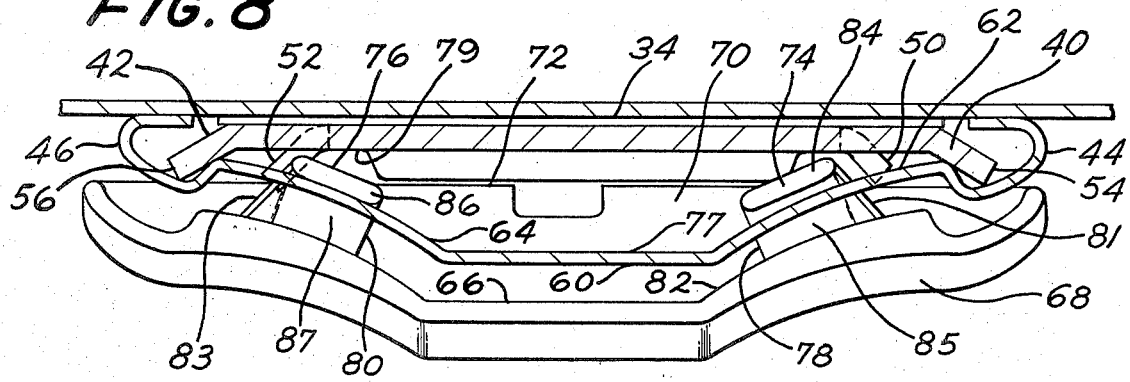
FIG. 9
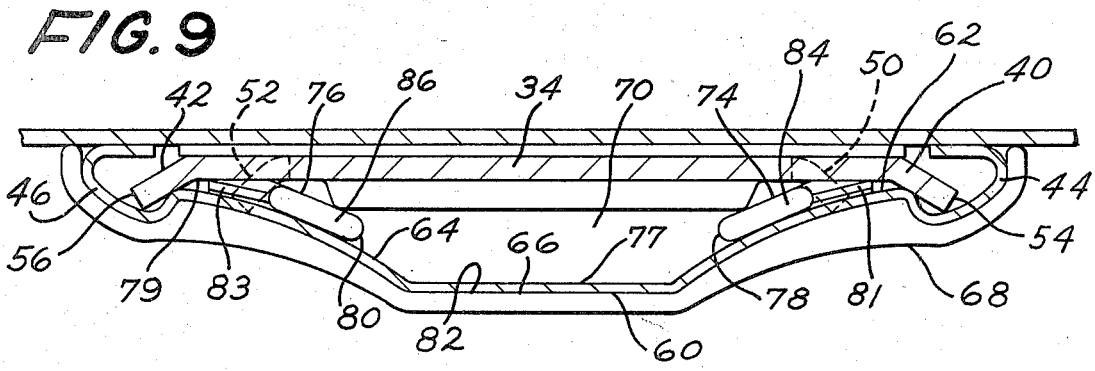

TRIM STRIP ASSEMBLY

BACKGROUND OF THE INVENTION

The present invention relates to a trim strip assembly and in particular to trim strip assemblies used in connection with door handles such as for use with large appliances like refrigerators.

Trim strip assemblies commonly use a rigid member fastened to a substrate body such as the door of a refrigerator and that rigid member then is covered by a decorative trim strip which is secured to the rigid member in a suitable manner. After the trim strip has been secured to the rigid member, the end of the rigid member and trim strip are covered with an end cap which can be readily snapped into place and retained securely in place in a manner such that there are no visible means for securing the trim strip assembly to the substrate body. In such assemblies should it be necessary to remove the trim strip assembly from the substrate body, such as to replace the handle, it is desirable that the end cap be easily removable yet during its installation be firmly secured to the trim strip and rigid member so as not to be loose or easily displaced during normal usage of the refrigerator. Heretofore many such end caps were composed of multiple components that had to be subassembled and then the end cap secured to the rigid member and trim strip. Usually these end caps included some form of spring that would exert sufficient force to grip and hold the end cap in place.

By this invention there is provided a trim strip assembly that includes an end cap that is integrally molded in one piece and functions to be easily and correctly assembled with the rigid member and trim strip to provide a rigid trim strip assembly yet the end cap may be easily removed for removing the trip strip assembly from the substrate body if need be.

SUMMARY OF THE INVENTION

The present invention in accordance with one form thereof relates to a trim strip assembly attached to a substrate body and includes an elongated rigid member fastened to the substrate body which rigid member has a terminal end with spaced upturned tabs. A trim strip is secured to the rigid member and has two parallel longitudinal downwardly curved elongated areas and a terminal end. An end cap is provided having a forward terminal end, a top wall, and a rear wall the bottom edge of which abuts the end of the rigid member. The end cap has two spaced flat resilient legs projecting from the rear wall and their forward ends extending beyond the forward terminal end and each leg is in contact with a respective longitudinal downwardly curved elongated area of the trim strip. Each leg is spaced from the top wall to allow insertion under the terminal end of the trim strip and each leg lies in a plane that bisects the other and at the same acute angle relative to the horizontal plane. Each leg has a cutout portion at the rear to receive the respective upturned tabs of the rigid member when the end cap is secured to the rigid member and trim strip.

BRIEF DESCRIPTION OF THE DRAWINGS

FIG. 4 shows a perspective exploded view of the trim strip assembly of the present invention.

FIG. 8 shows the partial assembly of the trim strip assembly of the present invention taken along lines 8—8 of FIG. 6.

FIG. 9 shows the complete assembly of the trim strip assembly of the present invention taken along lines 9—9 of FIG. 7.

DESCRIPTION OF THE PREFERRED EMBODIMENT

Figure 1:
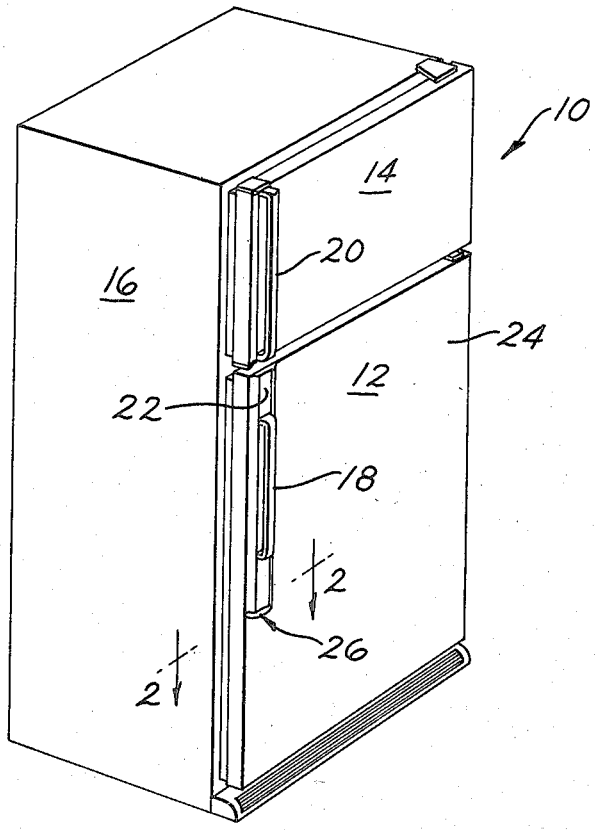
FIG. 1 is a perspective view of a household refrigerator embodying the present invention.

With reference to FIG. 1 there is shown a household refrigerator 10 having a fresh food door 12 and an upper freezer door 14 both of which are hingedly attached to the cabinet 16 for access to the respective compartments. The doors 12 and 14 have handles 18 and 20 respectively which are secured to the doors in such a manner that the attachment means, usually screws, are hidden from view by a decorative trim strip 22. The bottom end of the trim strip 22 is finished with an end cap 26 to cover up the fastening means and raw edges of the trim strip.

With reference particularly to FIG. 4, the components of the trim strip assembly of this invention will be described. To lend structural support to the handle 18, there is an elongated rigid member 28 usually made of sheet matal and fastened at the bottom to the outer surface 24 of the fresh food compartment door 12 by screw fastening means 30. The elongated rigid member 28 is then covered with a decorative trim strip 32 which is secured to the elongated rigid member 28 by any suitable means. In the preferred embodiment of this invention the elongated rigid member 28 has a flat portion 34 abutting the front face of door 12 which may be considered the substrate body 24 to which the trim strip assembly is fastened. The elongated rigid member 28 has two longitudinal edges 36 and 38 that have respective portions thereof formed as ears 40 and 42 which diverge away from the central flat portion 34 as can be seen particularly in FIGS. 4, 8 and 9. The trim strip 32 has reverse inwardly turned edges 44 and 46 along the longitudinal length of the trim strip and these edges receive the respective ears 40 and 42 of the rigid member as shown in FIGS. 8 and 9. With this arrangement then the trim strip 32 is fastened to the elongated rigid member 28 without any visible fastening means. To complete the trim strip assembly there is an end cap 26 which is secured to the elongated rigid member 28 and the trim strip 32. Elongated rigid members, trim strips, and some other form of end caps have been used to make trim strip assemblies heretofore. However, there has been a problem on how to retain the end cap firmly connected to the rigid member and trim strip yet have it easily removable to gain access to the fastener 30 securing the rigid member 28 to the substrate body 24. This usually included a multi-component end cap including a spring to exert force to retain it in place. A detailed description of how that is accomplished with a single piece integrally molded plastic end cap in this invention will now be discussed.

With reference to FIG. 4, the elongated rigid member 28 in this embodiment has a terminal end 48 that has spaced upturned tabs 50 and 52, the purpose of which will be discussed later. In assembling the trim strip 32 with the elongated rigid member 28, the edges 44 and 46 of the trip strip 32 are guided over the terminal end 48 of the elongated rigid member 28 and the channel formed by the inwardly turned edges 44 and 46 and body of trim strip is slightly larger in dimension than the distance between the ends 54 and 56 of the respective ears 40 and 42 so that the trim strip 32 is guided or slipped over the ears along the longitudinal axis of the elongated rigid member 28. The trim strip 32, when properly located relative to the elongated rigid member, exposes the terminal end 48 and also a portion of the elongated rigid member including the screw fastener 30 which passes through an aperture 58 into the substrate body 24. In the case of refrigerator trim strip assemblies the handle 18 is secured by screw fasteners through both the trim strip 32 and the elongated rigid member 28. The trim strip 32 has a central flat portion 60 and two parallel longitudinal downwardly curved elongated areas 62 and 64, one on each side of the central flat portion 60.

Figure 3:
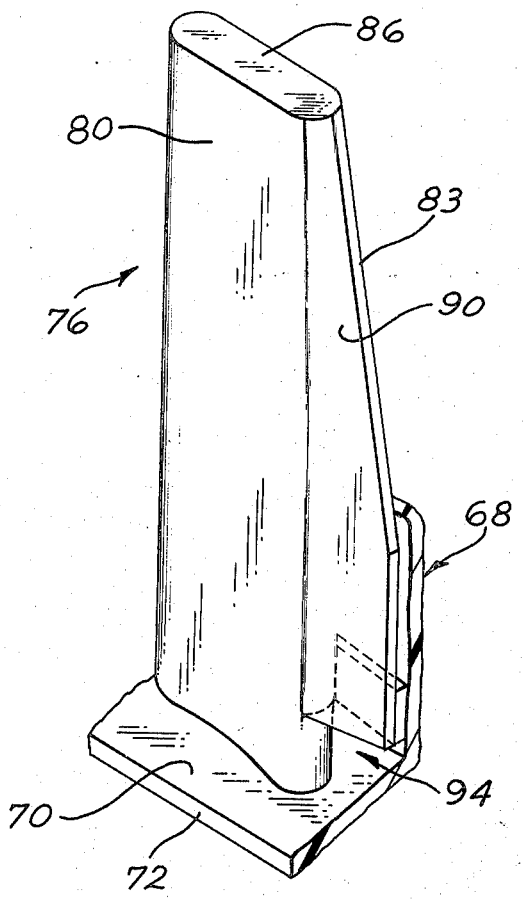
FIG. 3 is a portion of the end cap taken along lines 3—3 of FIG. 2 but shown in perspective.
Figure 2:
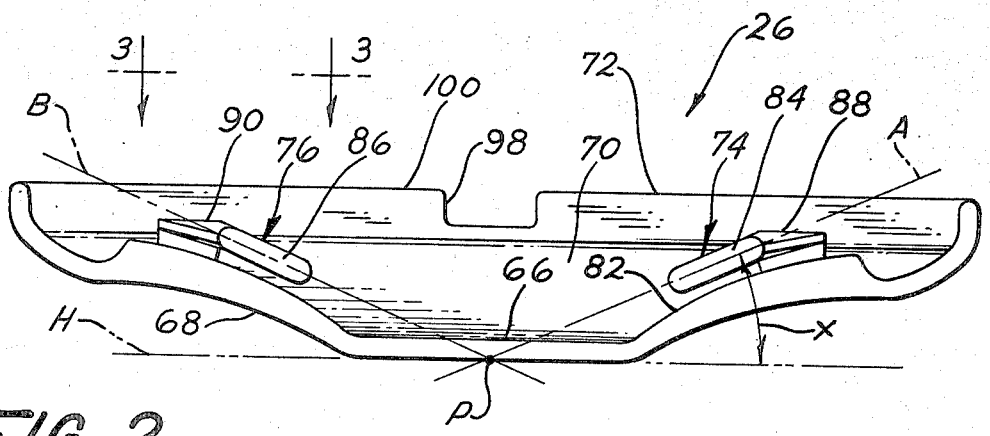
FIG. 2 is a front elevational view of the end cap portion of the present invention taken along lines 2—2 of FIG. 1.
Figure 10:
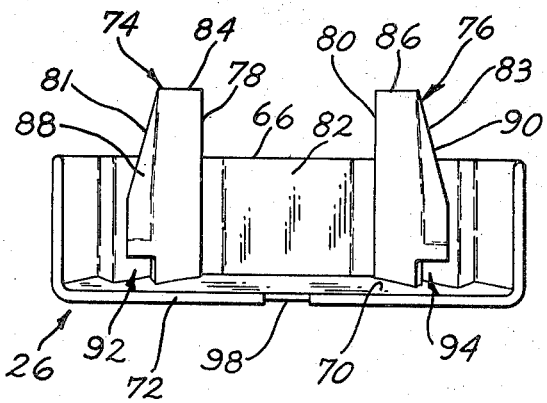
FIG. 10 is an elevational view of the end cap portion of the present invention.

The end cap 26 has a forward terminal end 66, a top wall 68 which is similarly shaped in lateral cross section as the trim strip 32. The end cap also has a rear wall 70 which abuts the terminal end 48 of the elongated rigid member 28 when the assembly is completed. With particular reference to FIGS. 2, 3 and 10, the end cap 26 has two spaced flat resilient legs 74 and 76 projecting from the rear wall 70 and their forward ends 78 and 80 respectively extend beyond the forward terminal end 66. Each of the legs 74 and 76 are spaced from the bottom surface 82 of the top wall 68 a distance slightly larger than the thickness of the trim strip 32 so that the trim strip may fit between the legs 74 and 76 and the bottom surface 82 of the top wall. Each leg 74 and 76 lies in a plane, designated "A" and "B" respectively in FIG. 2, that bisects the other at a line "P" at the same acute angle relative to the horizontal plane designated "H". The acute angle can be between 15° and 35° relative to the horizontal and in the preferred embodiment the acute angle designated "X" is 25°.

Each of the legs 74 and 76 has a forward portion 78 and 80 respectively, the outer edges 81 and 83 of which are tapered toward the terminal ends 84 and 86 respectively and each of the tapered outer edges 81 and 83 has a beveled bottom surface 88 and 90 with beveled surfaces are essentially in a plane parallel to the horizontal plane "H" as most readily seen in FIG. 2. At the rear of each of the legs 74 and 76 there is a cutout portion 92 and 94 respectively adjacent the rear wall 70. These cutout portions are slightly larger than the tabs 50 and 52 of the elongated rigid member 28 so that they may receive those tabs during assembly of the trim strip assembly.

Figure 5:
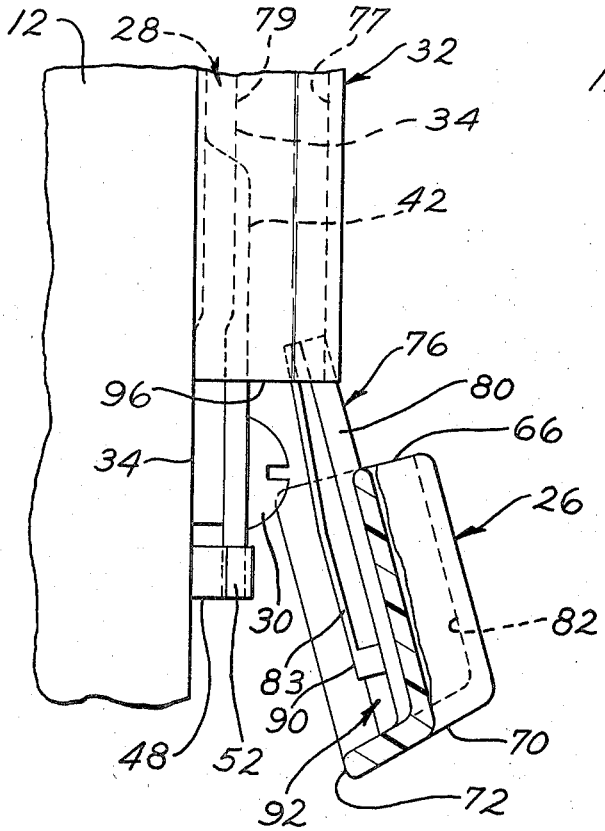
FIG. 5 shows the first step in attaching the end cap portion of the trim strip assembly of the present invention.
Figure 6:
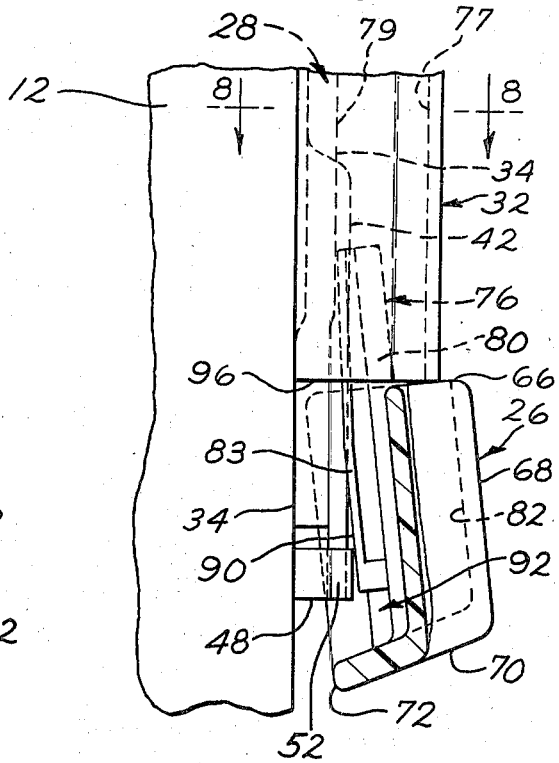
FIG. 6 shows an intermediate step in attaching the end cap portion of the trim strip assembly of the present invention.
Figure 7:
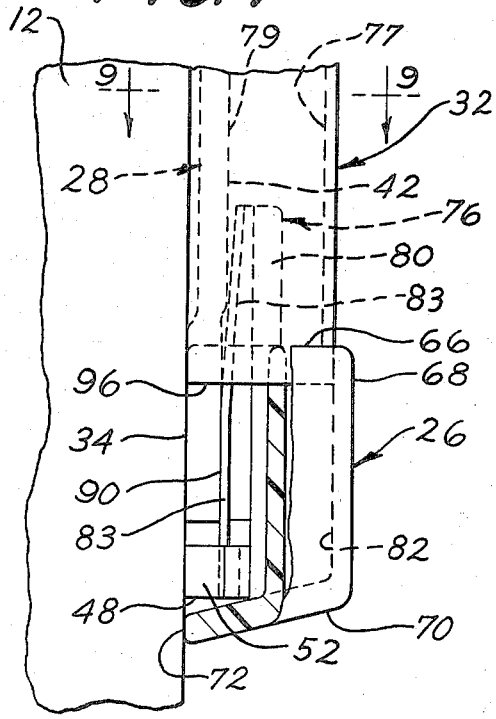
FIG. 7 shows the completed assembly of the trim strip assembly of the present invention.

With the above-described structural arrangement of the three components of the trim strip assembly and after completion of attaching the elongated rigid member 28 to the substrate body and the securement of the trim strip 32 to the elongated rigid member 28 as described above, the end cap 26 is secured to the assembly. As shown in FIGS. 5–9, the end cap 26 is positioned over the terminal end 48 of the elongated rigid member with the legs 74 and 76 being inserted between the elongated rigid member 28 and the underneath surface 77 of the trim strip 32 as shown in FIG. 5. The end cap is then urged toward the trim strip terminal end 96 and when it reaches the intermediate position shown in FIG. 6 the forward ends 78 and 80 of the resilient legs 74 and 76 contact the upper surface 79 of the flat portion 34 of the elongated rigid member and the upper surfaces 85 and 87 respectively of one or both of the resilient legs also engage the downwardly curved areas 62 and 64 of the trim strip 32. As an example, shown in FIG. 8 the resilient leg 76 is in contact with the downwardly curved area 64 while the leg 74 is not in contact with the downwardly curved area 62. However, the continued movement of the end cap inwardly of the trim strip causes the end cap to be centered relative to the elongated rigid member by the camming action between the angled flat upper surface 87 of flexible leg 76 and the downwardly curved area 64 forcing the end cap to center itself relative to the trim strip 32. When the end cap 26 is at the position shown in FIGS. 6 and 8, the beveled bottom surfaces 88 and 90 of the legs 74 and 76 respectively engage the upturned tabs 50 and 52 respectively of the elongated rigid member. With the beveled surfaces being parallel to the horizontal plane "H," the end cap and legs slide over the upturned tabs 50 and 52 thus causing some flexing of the legs 74 and 76 near the completion of the inward movement of the end cap. When the end cap has received the trim strip terminal end 96 between the legs 74 and 76 and the bottom surface of the top wall, the end cap is advanced to allow the tabs 50 and 52 to be received in the cutout portions 92 and 94 behind the legs 74 and 76 and snapped down into a fixed position shown in FIGS. 7 and 9. With this arrangement the end cap is retained by the resilient legs 74 and 76 exerting biasing force in its proper position on the elongated rigid member and the trim strip without any visible means of attachment. To remove the end cap should it become necessary there is provided a shallow cutout area 98 at the bottom edge 72 of the rear wall 70 so that a screwdriver or other instrument may be inserted and raised up slightly to overcome the resilient leg biasing force thus popping the end cap upward from the elongated rigid member whereupon it may be gripped and pulled downward and removed from the assembly.

By the above-described trim strip assembly it will be apparent that there is provided an easily assembled, self-aligning one piece integrally molded plastic end cap that is retained in its proper position during usage of the assembly but may be easily removed if need be.

While, in accordance with the patent statutes, there has been described what at present is considered to be the preferred embodiment of the invention, it will be obvious to those skilled in the art that various changes and modifications may be made thereto without departing from the invention. It is therefore intended by the appended claims to cover all such changes and modifications as fall within the true spirit and scope of the invention.

What is claimed is:

1. A trim strip assembly attached to a substrate body comprising:

an elongated, rigid member fastened to the substrate body, said rigid member having a terminal end with spaced upturned tabs;

a trim strip secured to the rigid member, said trim strip having two parallel longitudinal downwardly curved elongated areas and a terminal end; and an end cap secured to the rigid member and trim strip having a forward terminal end, a top wall, and a rear wall, the bottom edge of which abuts the end of the rigid member, said end cap having two spaced flat resilient legs projecting from the rear wall and their forward ends extending beyond the forward terminal end and each leg in contact with a respective longitudinal downwardly curved elongated area of the trim strip, each leg being spaced from the top wall to allow insertion under the terminal end of the trim strip and each leg lies in a plane that bisects the other and at the same acute angle relative to the horizontal plane, said legs each having a cutout portion at the rear to receive the respective upturned tabs of the rigid member.

2. The trim strip assembly of claim 1 wherein each of said legs has a forward portion of the outer edge tapered toward the forward end and said outer edges each have a beveled surface in a plane parallel to the horizontal plane between the forward end of the leg and the cutout portion at the rear of each leg, each said beveled surface being adjacent and forward of the respective cutout portion.

3. The trim strip assembly of claim 1 wherein the acute angle of the plane in which each leg lies relative to the horizontal plane is between 15° and 35°.

4. The trim strip assembly of claim 1 wherein the bottom edge of the rear wall of the end cap has at the center thereof a shallow cutout area.

5. The trim strip assembly of claim 1 wherein the top wall of the end cap is shaped the same as the trim strip.

6. The trim strip assembly of claim 1 wherein the rigid member has a flat portion abutting the substrate body and a portion of each of the longitudinal edges are formed to diverge away from the central flat portion and the trim strip has reverse inwardly turned edges along its longitudinal length, said edges receive the respective portion of the longitudinal edge of the rigid member diverging away from the central flat portion to secure the trim strip to the rigid member.

* * * * *